US007075235B2

(12) United States Patent
Lee

(10) Patent No.: US 7,075,235 B2
(45) Date of Patent: Jul. 11, 2006

(54) PLASMA DISPLAY PANEL WITH OPEN AND CLOSED DISCHARGE CELLS

(75) Inventor: Tae-Ho Lee, Ahsan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 95 days.

(21) Appl. No.: 10/774,608

(22) Filed: Feb. 10, 2004

(65) Prior Publication Data

US 2004/0164677 A1 Aug. 26, 2004

(30) Foreign Application Priority Data

Feb. 21, 2003 (KR) ..... 10-2003-0010997

(51) Int. Cl.
*H01J 17/49* (2006.01)

(52) U.S. Cl. ..... 313/582; 313/252; 313/292

(58) Field of Classification Search ..... 313/493, 313/567, 581, 582, 586, 634, 252, 292
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Sinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,388,644 | B1 * | 5/2002 | De Zwart et al. | 345/60 |
| 6,525,469 | B1 * | 2/2003 | Huang et al. | 313/582 |
| 6,630,916 | B1 | 10/2003 | Shinoda | |
| 6,707,436 | B1 | 3/2004 | Setoguchi et al. | |

FOREIGN PATENT DOCUMENTS

JP 02-148645 6/1990

(Continued)

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Ralationship Between Voltage Terms And Discharge Characteristics; Annex C—Gaps and Annex D—Manufacturing.

(Continued)

*Primary Examiner*—Vip Patel
(74) *Attorney, Agent, or Firm*—Robert E. Bushnell, Esq.

(57) ABSTRACT

A plasma display panel includes a first substrate, and a second substrate opposing the first substrate with a predetermined gap therebetween. Barrier ribs are mounted between the first substrate and the second substrate, and define a plurality of discharge cells. At least one row of every three rows of the discharge cells is formed in an open configuration to thereby realize open discharge cells, and the other rows of the discharge cells excluding the at least one row include discharge cells formed in a closed configuration to thereby realize closed discharge cells.

11 Claims, 3 Drawing Sheets

FOREIGN PATENT DOCUMENTS

| | | |
|---|---|---|
| JP | 08-335440 | 12/1996 |
| JP | 2845183 | 10/1998 |
| JP | 2917279 | 4/1999 |
| JP | 2000-228150 | 8/2000 |
| JP | 2001-043804 | 2/2001 |
| JP | 2001-325888 | 11/2001 |
| JP | 2002-83545 | 3/2002 |
| JP | 2002-175762 | 6/2002 |

OTHER PUBLICATIONS

*Office action* from the Korean Intellectual Property Office issued in Applicant's corresponding Korean Patent Application No. 2003-0010997 dated Dec. 18, 2005.

* cited by examiner

PLASMA DISPLAY PANEL WITH OPEN AND CLOSED DISCHARGE CELLS

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on Feb. 21, 2003 and there duly assigned Serial No. 2003-0010997.

BACKGROUND OF THE INVENTION

1. Field of the Invention

The present invention relates to a plasma display panel (PDP), and more particularly, to the arrangement of barrier ribs of a PDP to form both open and closed discharge cells.

2. Description of the Related Art

PDPs are emerging as one of the most popular flat panel display configurations used for wall-mounted televisions and other similar large-screen display applications. Predetermined images are displayed on the PDP using a discharge mechanism of discharge cells. In more detail, the PDP combines two substrates on which a plurality of electrodes is formed to realize a vacuum assembly, and discharge gas is provided between the two substrates before sealing the same. Discharge voltages are applied to the electrodes to thereby effect plasma discharge, and ultraviolet rays generated during discharge excite phosphors formed in a predetermined pattern to thereby realize the display of desired numbers, characters, and/or graphics.

PDPs are classified into two different discharge types, namely, a DC PDP and an AC PDP, depending on the drive voltage waveform. PDPs can also be classified into either an opposing discharge PDP or a surface discharge PDP, depending on the electrode structure.

Discharge cells are defined by barrier ribs formed in a predetermined pattern (for example, a stripe pattern or a lattice pattern) on one of the substrates. The barrier ribs act to separate the discharge cells corresponding to a pixel pattern and also function as a spacer to maintain a cell gap between the two substrates.

The different formations of the barrier ribs have different advantages. In particular, with the use of stripe barrier ribs, the many discharge cells present between the barrier ribs are in communication (i.e., the discharge cells between each pair of adjacent barrier ribs are in communication), and as a result, exhaust of the PDP and sealing of the discharge gas within the PDP are relatively easily performed during manufacture.

With closed barrier ribs realized by a lattice pattern of the same, on the other hand, the discharge cells are not in communication. That is, the barrier ribs are formed into individual units having a quadrilateral, hexagonal, or other such shape. With the closed barrier ribs, the discharge cells are separately formed for each pixel, and phosphors can be deposited over all inner surfaces of barrier ribs that form each pixel. Therefore, an area of illumination for each unit pixel is increased by increasing the amount of space on which phosphors can be deposited. The result is an increased brightness of the PDP.

This advantage of the lattice barrier rib structure has led to greater application of the same over the stripe configuration in recent times.

However, the barrier ribs provided in a lattice pattern make exhaust of the PDP difficult during manufacture. In more detail, depressions are typically formed on distal ends of the barrier ribs such that gaps are formed between the barrier ribs and an element of the substrate opposing the substrate on which the barrier ribs are formed, for example, an MgO oxidation layer. Although these gaps form exhaust paths to allow evacuation of the PDP, the minimal size of the gaps is such that there is significant resistance during this process. Japanese Laid-Open Patent No. 2002-175762 relates to a PDP with this structure.

A different configuration is introduced in Japanese Laid-Open Patent No. Heisei 2002-83545 which relates to a PDP where closed barrier ribs are formed using a material that has a heat shrink property. The barrier ribs are formed having areas of a lesser height that function as exhaust paths to thereby form a mesh-type structure of the exhaust paths. Although it is claimed that such a barrier rib structure reduces exhaust resistance during the evacuation process, there is a limited number of actual paths through which exhaust can occur as a result of the mesh configuration. This can result in insufficient exhaust of the PDP.

The following patents each discloses features in common with the present invention but do not teach or suggest the inventive features specifically recited in the present application: Japanese Patent Publication No.2002-175762 to Ueda, entitled *PLASMA DISPLAY PANEL AND ITS MANUFACTURING METHOD*, published on Jun. 21, 2002, and Japanese Patent Publication No. 2002-83545 to Kunii, et al., entitled *PLASMA DISPLAY PANEL AND METHOD FOR MANUFACTURING THE SAME*, published on Mar. 22, 2002.

SUMMARY OF THE INVENTION

In one exemplary embodiment of the present invention, there is provided a plasma display panel that improves a barrier rib structure such that exhaust efficiency is enhanced during manufacture.

In an exemplary embodiment of the present invention, a plasma display panel includes a first substrate, a second substrate opposing the first substrate with a predetermined gap therebetween, and barrier ribs mounted between the first substrate and the second substrate defining a plurality of discharge cells. At least one row of every three rows of the discharge cells is formed in an open configuration to thereby realize open discharge cells, and the other rows of the discharge cells excluding the at least one row include discharge cells formed in a closed configuration to thereby realize closed discharge cells.

Phosphor films realized through red, green, and blue phosphors are formed in the discharge cells. The red phosphors can be formed in the open discharge cells, and the green and blue phosphors can be formed in the closed discharge cells.

The open discharge cells and the closed discharge cells are formed in a predetermined pattern and this pattern is repeated. The open discharge cells can be formed in a stripe pattern and the closed discharge cells can be formed into quadrilateral shapes.

In one exemplary embodiment, the closed discharge cells are defined by first barrier ribs formed in a lattice configuration, and the open discharge cells are defined by spaces formed by the first barrier ribs.

In another exemplary embodiment, the closed discharge cells are defined by first barrier ribs formed in a lattice configuration, and the open discharge cells are defined by spaces formed by the first barrier ribs and by second barrier ribs mounted in the spaces.

One cell unit can include two rows of the closed discharge cells and one row of the open discharge cells, and the cell units are repeatedly formed. Alternatively, one cell unit can include one row of the closed discharge cells and two rows of the open discharge cells, and the cell units are repeatedly formed.

Red and blue phosphors can be formed in the open discharge cells, and the green phosphors can be formed in the closed discharge cells.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Embodiments of the present invention will now be described in detail with reference to the accompanying drawings.

Figure 1:
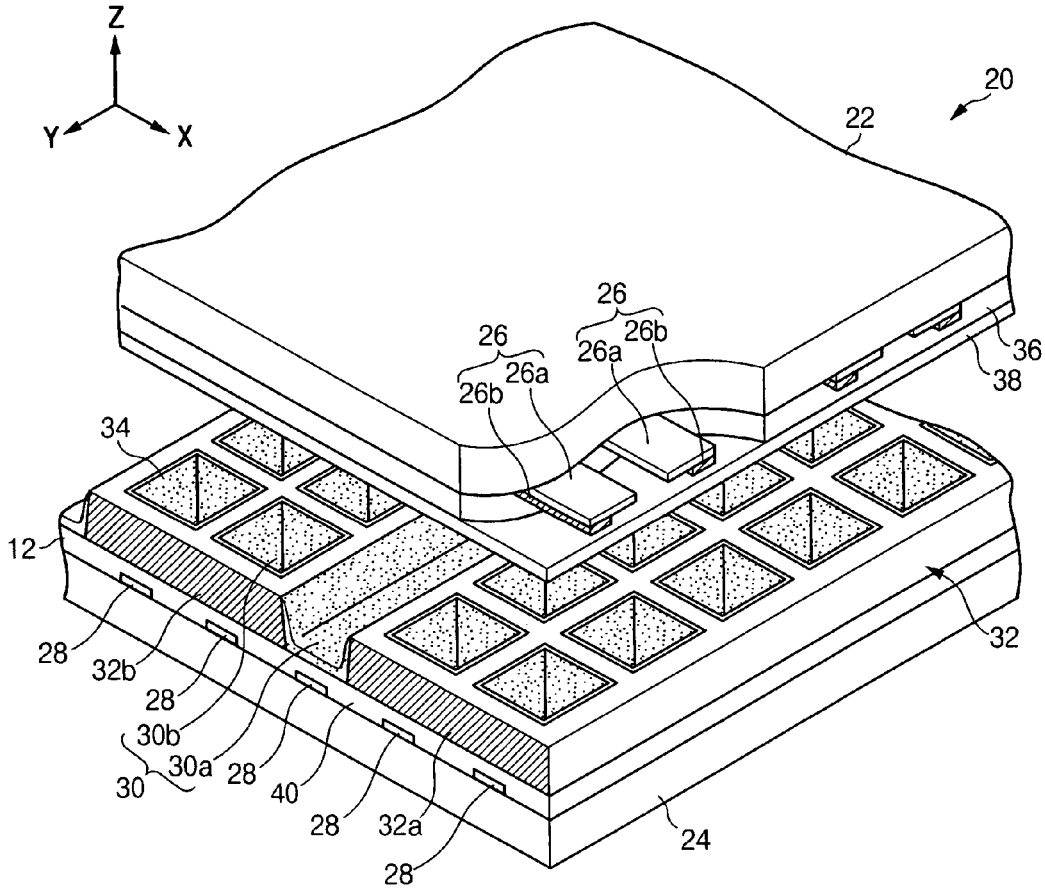
FIG. 1 is a partial exploded perspective view of a plasma display panel according to an exemplary embodiment of the present invention.
Figure 2:
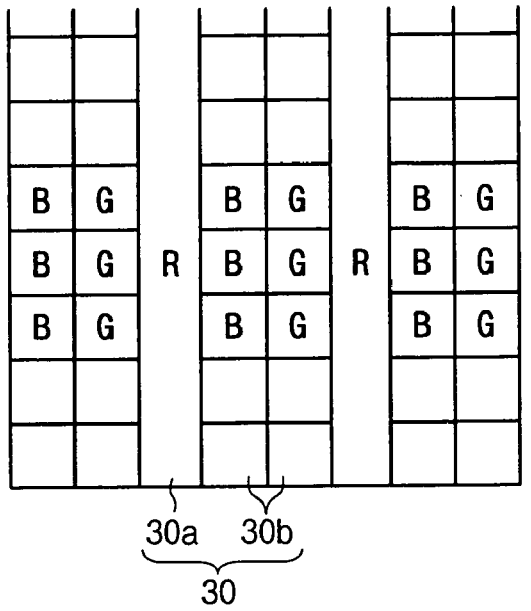
FIG. 2 is a partial exploded plan view of a barrier rib structure and arrangement of R, G, and B phosphors in the plasma display panel of FIG. 1.

Referring to FIGS. 1 and 2, a plasma display panel (PDP) 20 includes a first substrate 22 and a second substrate 24 opposing one another with a predetermined gap therebetween. The first and second substrates 22 and 24 are made of a transparent glass. A configuration is provided between the first and second substrates 22 and 24 such that images are displayed by a discharge mechanism.

In more detail, discharge sustain electrodes 26 are formed on the first substrate 22 (or front substrate), and address electrodes 28 are formed on the second substrate 24 (or rear substrate). Further, barrier ribs 32 are formed between the first substrate 22 and the second substrate 24 to define a plurality of discharge cells 30 therebetween in which a discharge occurs. Phosphor films 34 comprised of R, G, and B phosphors are formed in the discharge cells 30.

A first dielectric layer 36 is deposited on the first substrate 22 covering the discharge sustain electrodes 26, and a protection layer 38 is deposited on the dielectric layer 36. A second dielectric layer 40 is deposited on the second substrate 24 covering the address electrodes 28 to be positioned between the address electrodes 28 and the barrier ribs 32. The phosphor films 34 are formed covering inner walls of the barrier ribs 32 and an upper, exposed surface of the second dielectric layer 40 within the discharge cells 30.

The discharge sustain electrodes 26 are mounted on the first substrate 22 substantially perpendicular to the address electrodes 28 formed on the second substrate 24. Each of the discharge sustain electrodes 26 includes a transparent electrode 26*a* and an opaque bus electrode 26*b*. The transparent electrodes 26*a* can be made of ITO and the opaque bus electrodes 26*b* can be made of metal.

The transparent electrodes 26*a* are paired together in electrode formations in which two of the transparent electrodes 26*a* oppose one another in areas corresponding to each discharge cell 30. One of the bus electrodes 26*b* is formed on each of the transparent electrodes 26*a* and electrically connected thereto and is arranged substantially perpendicular to the address electrodes 28.

The barrier ribs 32 provided in this structure are formed having the following features with respect to formation and arrangement.

If"rows" of the barrier ribs 32 refer to a grouping thereof that are formed adjacent along the direction the address electrodes 28, at least one of every three rows of the barrier ribs 32 is formed in an open configuration such that discharge cells 30*a* in this row are in communication. The remaining two rows of each set of three rows are formed in a closed configuration such that discharge cells 30*b* of these rows are formed as separate units.

In an exemplary embodiment of the present invention, the discharge cells 30 are arranged by repeating a predetermined pattern. In this exemplary embodiment, the discharge cells 30 are formed in cell units of two adjacent rows of the discharge cells 30*b* formed in a closed configuration (also referred to as closed discharge cells), and one row of the discharge cells 30*a* formed in an open configuration (also referred to as open discharge cells). This cell unit structure is repeated over most of the second substrate 24.

The closed discharge cells 30*b* are formed by first barrier ribs 32*a* having a lattice configuration, and the open discharge cells 30*a* are formed in a space between the first barrier ribs 32*a*, that is, a space formed between paired rows of the closed discharge cells 30*b* formed by the first barrier ribs 32*a*. The open discharge cells 30*a* are formed in a stripe pattern, and the closed discharge cells 30*b* are formed into quadrilateral shapes as a result of the lattice configuration of the first barrier ribs 32*a* as described above. However, the present invention is not limited in this regard and it is possible to realize various different open and closed configurations.

With reference to FIG. 2, for each of the cell units, a green phosphor layer G is formed in the closed discharge cells 30*b* of one of the two adjacent rows of the same, and a blue phosphor film B is formed in the closed discharge cells 30*b* of the other of the two adjacent rows of the same. Also, a red phosphor film R is formed in the open discharge cells 30*a* of the third row comprising the cell unit. Green phosphors significantly affect brightness and blue phosphors significantly affect color purity. Red phosphors, however, have minimal impact on both brightness and color purity.

Since there is an increased number of walls (i.e., increased area) on which phosphors can be printed in the case of the closed discharge cells 30*b*, green and blue phosphors, which significantly affect brightness and color purity, respectively, are applied to these closed discharge cells 30*b*. The red phosphors, which have only a limited affect on brightness and color purity, are applied to the open discharge cells 30*a*. That is, utilizing the fact that red phosphors only minimally affect brightness and color purity of the PDP, every third row of the discharge cells 30 is formed as the open discharge cells 30*a* and the red phosphors are formed therein. The open discharge cells 30*a* enable easier exhaust of the PDP as a result of these open rows of the open discharge cells 30*a* that act as exhaust paths during manufacture.

In the exemplary embodiment described above, manufacture is made easy by forming the open rows of the open discharge cells 30*a* by simply omitting one row in each cell unit of the closed discharge cells 30*b* formed by the first barrier ribs 32*a* of a lattice configuration (rather than by forming additional lattice walls for the formation of the discharge cells 30*a*).

Figure 3:
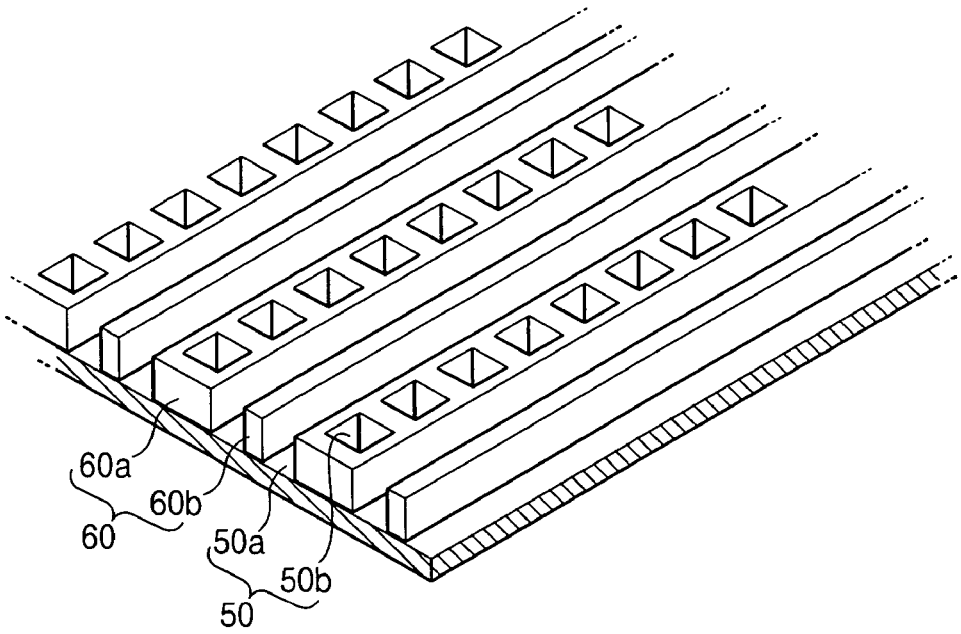
FIG. 3 is a partial exploded perspective view of a plasma display panel according to another exemplary embodiment of the present invention.
Figure 4:
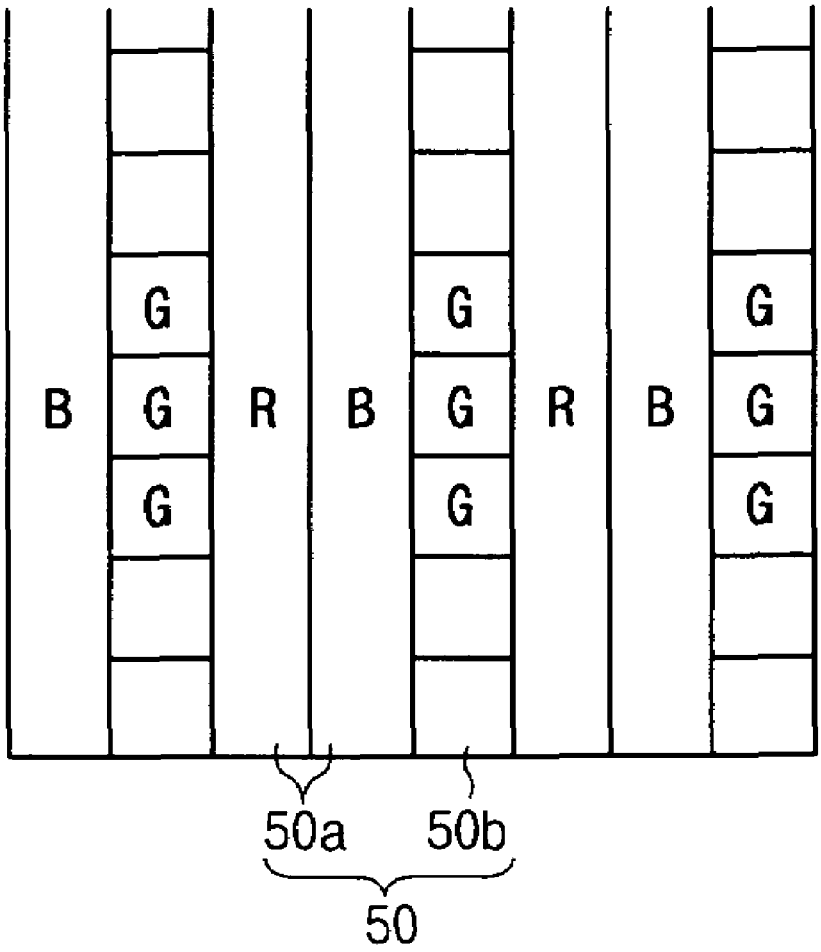
FIG. 4 is a partial exploded plan view of a barrier rib structure and arrangement of R, G, and B phosphors in the plasma display panel of FIG. 3.

A PDP according to another exemplary embodiment of the present invention, with reference to FIGS. 3 and 4, includes barrier ribs 60 that form discharge cells 50. That is, for every three adjacent rows of the discharge cells 50 that are formed along the direction address electrodes (not shown), two rows are comprised of open discharge cells 50*a* formed in a stripe pattern, and the remaining one row is comprised of closed discharge cells 50*b* formed into quadrilateral shapes. The barrier ribs 60 include first barrier rib members 60*a* that form the closed discharge cells 50*b*, and second barrier rib members 60*b* that form the open discharge cells 50*a*.

Referring to FIG. 4, a green phosphor film G is formed in each of the closed discharge cells 50*b*. Green phosphors forming the green phosphor film G significantly affect brightness of the PDP. Further, for each of the three adjacent rows of the discharge cells 50, a blue phosphor film B is formed in one of the two rows comprising the open discharge cells 50*a* and a red phosphor film R is formed in the other of the two rows comprising the open discharge cells 50*a*.

In this embodiment of the present invention, the second barrier ribs 60*b* and the first barrier ribs 60*a* are alternatingly formed at predetermined intervals along a direction substantially perpendicular to the direction the address electrodes (not shown). That is, the lattice-type first barrier ribs 60*a* are formed at predetermined intervals, and the stripe-type second barrier ribs 60*b* are formed substantially centered between two adjacent first barrier ribs 60*a* such that the spaces therebetween are divided approximately into two equal sections to form the open discharge cells 50*a*. Each of these equal sections are formed to have a width in the direction substantially perpendicular to the direction of the address electrodes (not shown) corresponding to a width in the same direction of the closed discharge cells 50*b*.

In the PDP according to the exemplary embodiments of the present invention described above, the number of open discharge cells and closed discharge cells can be varied as needed.

Further, a configuration can be used that brings about the same effect as providing discharge cells of different widths. In particular, in order to increase the amount of illumination of specific phosphors to enhance a specific characteristic such as brightness or color purity, the barrier ribs forming the discharge cells in which these phosphors are deposited are provided in a lattice configuration, while the barrier ribs forming the discharge cells in which the other phosphors are deposited are provided in a stripe configuration. Areas of illumination are varied using these different configurations such that the amount of illumination of specific phosphors can be controlled.

In the PDP of the present invention described above, exhaust resistance is minimized by forming the stripe-type discharge cells that act as exhaust paths. Further, by avoiding the formation of the barrier ribs with height variations in an attempt to provide exhaust paths, the problems of phosphors being deposited on distal ends of the barrier ribs and of phosphors entering into discharge cells of adjacent rows of discharge cells during formation of the phosphor films are prevented.

In addition, desired panel characteristics such as brightness and color purity can be obtained by forming the discharge cells as individual units through lattice-type barrier ribs or in a stripe configuration. Stated differently, such manipulation allows the discharge cells to be formed to the same width while obtaining an effect as if the widths were different.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate;

a second substrate opposing the first substrate with a predetermined gap therebetween; and barrier ribs arranged between the first substrate and the second substrate to define a plurality of discharge cells;

wherein at least one row of every three rows of the discharge cells is arranged in a fully open configuration to form open discharge cells, and the other rows of the discharge cells excluding the at least one row include discharge cells are arranged in a fully closed configuration to form closed discharge cells.

2. The plasma display panel of claim 1, wherein first, second, and third phosphor films are arranged in the discharge cells; the first phosphor film being arranged in the open discharge cells; and the second and third phosphor films being arranged in the closed discharge cells.

3. The plasma display panel of claim 2, wherein first, second, and third phosphor films respectively comprise red, green, and blue phosphor films.

4. The plasma display panel of claim 1, wherein the open discharge cells and the closed discharge cells axe arranged in a repeated predetermined pattern.

5. The plasma display panel of claim 1, wherein the open discharge cells are arranged in a stripe pattern and the closed discharge cells are arranged into quadrilateral shapes.

6. The plasma display panel of claim 5, wherein the closed discharge cells are defined by first barrier ribs arranged in a lattice configuration, and the open discharge cells are defined by spaces formed by the first barrier ribs.

7. The plasma display panel of claim 5, wherein the closed discharge cells are defined by first barrier ribs arranged in a lattice configuration, and the open discharge cells are defined by spaces formed by the first barrier ribs and by second barrier ribs arranged in the spaces.

8. The plasma display panel of claim 6, wherein one cell unit comprises two rows of closed discharge cells and one row of open discharge cells, and wherein the cell units are arranged repeatedly.

9. The plasma display panel of claim 7, wherein one cell unit includes one row of closed discharge cells and two rows of open discharge cells, and wherein the cell units are arranged repeatedly.

10. The plasma display panel of claim 1, wherein first, second, and third phosphor films are arranged in the discharge cells; the first and third phosphor films being arranged in the open discharge cells; and the second phosphor film being arranged in the closed discharge cells.

11. The plasma display panel of claim 10, wherein first, second, and third phosphor films respectively comprise red, green, and blue phosphor films.

* * * * *